US006050779A

United States Patent [19]

Nagao et al.

[11] Patent Number: 6,050,779

[45] **Date of Patent: *Apr. 18, 2000**

[54] CONVEYING APPARATUS USING UNSTABLE ELECTRIC POWER SUPPLY

[75] Inventors: Yoshitaka Nagao, Ikoma; Kimitoshi Fukae, Nara; Nobuyoshi Takehara, Soraku-gun, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,992

[22] Filed: Apr. 9, 1997

[30] Foreign Application Priority Data

Apr. 12, 1996 [JP] Japan ..... 8-114415

[51] Int. Cl.[7] ..... F04B 49/00; F04B 35/04

[52] U.S. Cl. ..... 417/28; 417/36; 417/302; 417/411

[58] Field of Search ..... 417/18, 35, 36, 417/280, 302, 411, 28

[56] References Cited

U.S. PATENT DOCUMENTS

| | | | |
|---|---|---|---|
| 4,370,098 | 1/1983 | McClain et al. | 417/18 |
| 4,744,334 | 5/1988 | McAnally | 417/411 |
| 4,802,829 | 2/1989 | Miller | 417/36 |

FOREIGN PATENT DOCUMENTS

| | | |
|---|---|---|
| 56-132125 | 10/1981 | Japan . |
| 57-153531 | 9/1982 | Japan . |
| 6-348352 | 12/1994 | Japan . |

*Primary Examiner*—Charles G. Freay

*Attorney, Agent, or Firm*—Fitzpatrick, Cella, Harper & Scinto

[57] ABSTRACT

A conveying system comprising a pump whose power source is an unstable electric power supply, such as a solar cell; a first supply pipe for conveying liquid from an intake to the pump; a second supply pipe for conveying the liquid from the pump to a discharge opening; a liquid storage tank provided at a position which is below the discharge opening and above the pump; a third supply pipe branching from the second supply pipe, for conveying the liquid to the liquid storage tank; a fourth supply pipe connected between the liquid storage tank and the first supply pipe; a first valve, provided between the branching point of the first and fourth supply pipes and the intake, for opening and closing the first supply pipe; a second valve, provided between the branching point of the second and third supply pipes and the discharge opening, for opening and closing the second supply pipe; a third valve for opening and closing the third supply pipe; and a fourth valve for opening and closing the fourth supply pipe. The conveying system is capable of conveying liquid, fine powder, and so on, at high efficiency with a single pump even when available electric power supplied from the unstable electric power supply is low by performing open/close control of the second and fourth valves.

32 Claims, 9 Drawing Sheets

FIG. 13

| GENERATED ELECTRIC POWER | STORED AMOUNT | MODE | VALVES | | | |
|---|---|---|---|---|---|---|
| | | | 1ST | 2ND | 3RD | 4TH |
| LOW (20 TO 40W) | LOW | WATER STORING MODE ( DRAW WATER TO WATER TANK 6 ) | — | CLOSE | OPEN | CLOSE |
| | HIGH | WATER DISCHARGE MODE ( SUPPLY WATER FROM WATER TANK 6 ) | — | OPEN | CLOSE | OPEN |
| HIGH (MORE THAN 40W) | — | DIRECT MODE ( DIRECTLY SUPPLY WATER ) | — | OPEN | CLOSE | CLOSE |

FIG. 14

| GENERATED ELECTRIC POWER | STORED AMOUNT | MODE | VALVES | | | |
|---|---|---|---|---|---|---|
| | | | 1ST | 2ND | 3RD | 4TH |
| LOW (20 TO 40W) | LOW | WATER STORING MODE ( DRAW WATER TO WATER TANK 6 ) | OPEN | CLOSE | OPEN | CLOSE |
| | HIGH | WATER DISCHARGE MODE ( SUPPLY WATER FROM WATER TANK 6 ) | CLOSE | OPEN | CLOSE | OPEN |
| HIGH (MORE THAN 40W) | — | DIRECT MODE ( DIRECTLY SUPPLY WATER ) | OPEN | OPEN | CLOSE | CLOSE |

CONVEYING APPARATUS USING UNSTABLE ELECTRIC POWER SUPPLY

BACKGROUND OF THE INVENTION

The present invention relates to a conveying apparatus run by electric power from an unstable electric power supply and, more particularly, to a conveying apparatus for conveying liquid, such as water, and fine powder by using electric power supplied from an unstable electric power supply, such as a solar cell and a wind power generator, which generates variable electric power, as a power source.

Recently, anathermal of the earth, exhaustion of fossil fuels, and radioactive contamination caused by accidents in nuclear power plants and radioactive wastes have become social issues, and the issues on the terrestrial environment and energy are rapidly collecting interests of many people. Under this situation, a solar cell, for example, which generates electric power from the solar ray that is an inexhaustible clean energy source, is anticipated as the energy source of tomorrow.

There are various sizes of systems the solar cell, and the electric power required by those systems ranges from several watts to thousands of watts. Further, there are many types of systems: a system which directly uses electric power generated by the solar cell; a system which charges electric power generated by the solar cell to a storage battery; and a system which uses electric power generated by the solar cell along with commercial electric power, for example. Among these systems using the solar cell, a system suggested as a solar pump system for drawing water from the source, such as a well and a river, for irrigation and drinking is very useful especially in some geographic regions, such as tropical regions, where the amount of insolation is large, and in unelectrified regions, because the running cost of the system and the load of transportation of fuels for running the system can be saved. Further, it is also advantageous for highly electrified cities to own a solar pump system as measures to cope with a natural disaster, such as an earthquake, since it is possible to supply water relatively easily by using the solar pump system in a case where the supply of electric power and water stops.

FIG. 12 is a diagram illustrating a configuration of a water supply apparatus employing a solar pump system. In FIG. 12, direct current electric power obtained from a solar panel 12, i.e., an unstable electric power source, is provided to a pump 5 via an electric power regulator 14 whose output is controlled by a controller 13. The water in a well 15 is taken through the intake 7 of a water supply pipe 1 and drawn through the water supply pipe 2 up to the discharge opening 20 by the pump 5, then stored in a water tank 19. Note, in the water supply pipe 1, a foot valve 81 for preventing backflow of the water is provided near the intake 7 and a valve 8 which is closed for preventing backflow of the water when the pump 5 stops operating is provided.

However, the water supply apparatus as shown in FIG. 12 may not be able to draw water in the mornings and evenings when an amount of insolation is small and on cloudy days, since the electric power generated by the solar panel 12 becomes small, and although the pump 5 operates, the water does not reach the discharge opening 20.

In order not to waste the electric power generated by the solar cell when the amount of insolation is small, methods of using a plurality of low output pumps, as disclosed in Japanese Patent Application Laid-Open Nos. 56-132125 and 57-153531, are suggested. As shown in FIG. 2, however, the higher the output of a pump is, the better in efficiency.

Therefore, by using a plurality of low output pumps to obtain a predetermined output, and using a part of the pumps to supply water when the amount of insolation is small, less energy is wasted, however, the efficiency is not good, as can be seen from FIG. 2. Furthermore, the initial cost of the apparatus is high since a plurality of pumps are necessary.

Further, there is method of temporary storing electric power generated by the solar cell in a storage battery. However, the cost of the storage battery is considerably high and load of maintenance of the storage battery is not ignorable. In addition, it is necessary to control charging and discharging of the storage battery, which makes the system complicated.

SUMMARY OF THE INVENTION

The present invention has been made in consideration of the above situation, and has as its object to provide a reliable conveying apparatus, having a simple configuration, for conveying liquid or fine powder, which is run by electric power from an unstable power supply and capable of obtaining desirable efficiency by effectively using electric power supplied from the unstable power supply, and which does not waste electric power even when the available electric power is low, e.g., when the insolation is low for a solar cell and when wind is weak for a wind power generator.

According to the present invention, the foregoing object is obtained by providing a conveying apparatus which employs an unstable electric power supply as its power source for conveying liquid, the apparatus comprising: a first route for conveying the liquid from an intake to a pump; a second route for conveying the liquid from the pump to a discharge portion which is provided above the pump; a third route for conveying the liquid from the pump to liquid storage means provided at a position which is below the discharge portion and above the pump; and a fourth route for conveying the liquid from the liquid storage means to the pump, wherein in a case where available electric power level which can be supplied from the unstable electric power supply to the pump exceeds a predetermined electric power level, the first and second routes are opened and the third and fourth routes are closed to convey the liquid from the intake to the discharge portion, and in a case where the available electric power level is lower than the predetermined electric power level, the first and third routes are opened and the second and fourth routes are closed to convey the liquid from the intake to the liquid storage means.

The foregoing object is also attained by providing a conveying apparatus which employs an unstable electric power supply as its power source for conveying fine powder, the apparatus comprising: a first route for conveying the fine powder from an intake of the fine powder to a pump; a second route for conveying the fine powder from the pump to a discharge portion of the fine powder which is provided above the pump; a third route for conveying the fine powder from the pump to storage means provided at a position which is below the discharge portion and above the pump; and a fourth route for conveying the fine powder from the storage means to the pump, wherein in a case where available electric power level which can be supplied from the unstable electric power supply to the pump exceeds a predetermined electric power level, the first and second routes are opened and the third and fourth routes are closed to convey the fine powder from the intake to the discharge portion, and in a case where the available electric power level is lower than the predetermined electric power level, the first and third routes are opened and the second and fourth routes are closed to convey the fine powder from the intake to the storage means.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

FIG. 13 is a table showing an open/close control method of a valve according to the first embodiment;

FIG. 14 is a table showing an open/close control method of a valve according to the second and third embodiments.

DETAILED DESCRIPTION OF THE PREFERRED EMBODIMENTS

A configuration of a conveying apparatus of the present invention will be described in accordance with the accompanying drawings. Note, in the following explanation, a water supply system for drawing water from a well by using a pump whose energy source is a solar cell is described, however, it is possible to use a wind power generator instead of the solar cell. Further, water can be drawn from a river or a water tank instead of a well, and the conveying apparatus may convey any liquid or fine powder other than water. Furthermore, liquid or fine powder may be conveyed and supplied by using an apparatus other than a pump as far as the apparatus is run by electric power.

<First Embodiment>

Figure 1:
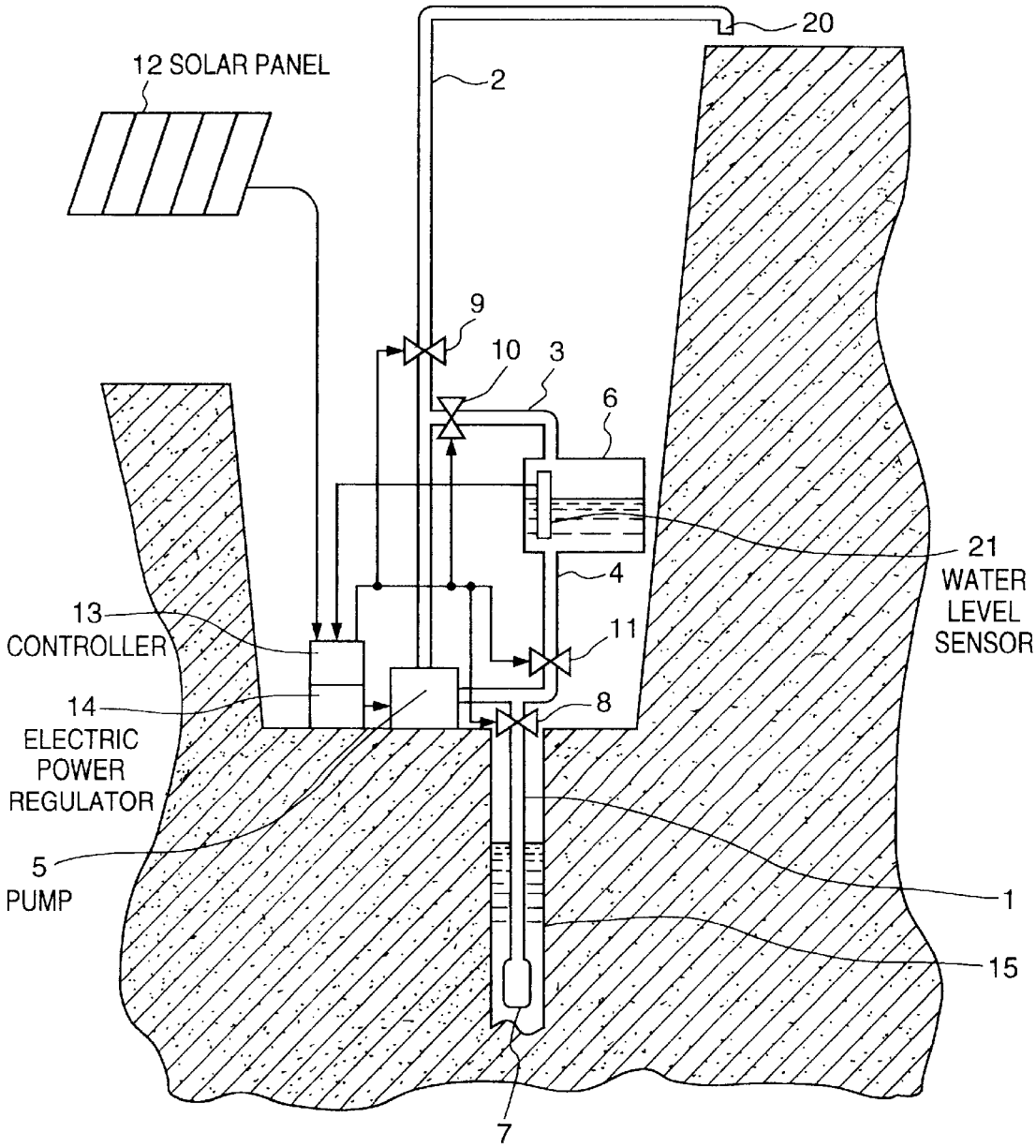
FIG. 1 is a drawing illustrating a configuration of a water supply system according to a first embodiment of the present invention.
Figure 2:
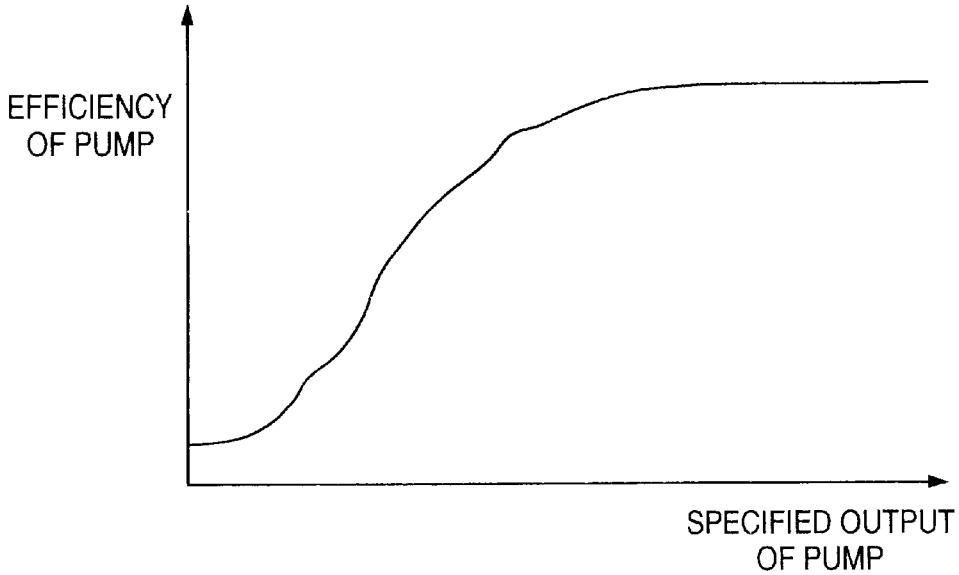
FIG. 2 is a graph showing relationship between the specified output and the efficiency of a pump.

FIG. 1 is a diagram illustrating a configuration of a water supply system according to the first embodiment. In FIG. 1, reference numerals 1 to 4 denote the first to fourth water supply pipes which are liquid conveyance routes; 5, a pump; 6, a water tank; 7, an intake of water; 8 to 11, the first to fourth valves; 12, a solar panel; 13, a controller; 14, an electric power regulator; 15, a well; 20, a discharge opening; and 21, a water level sensor.

Figure 12:
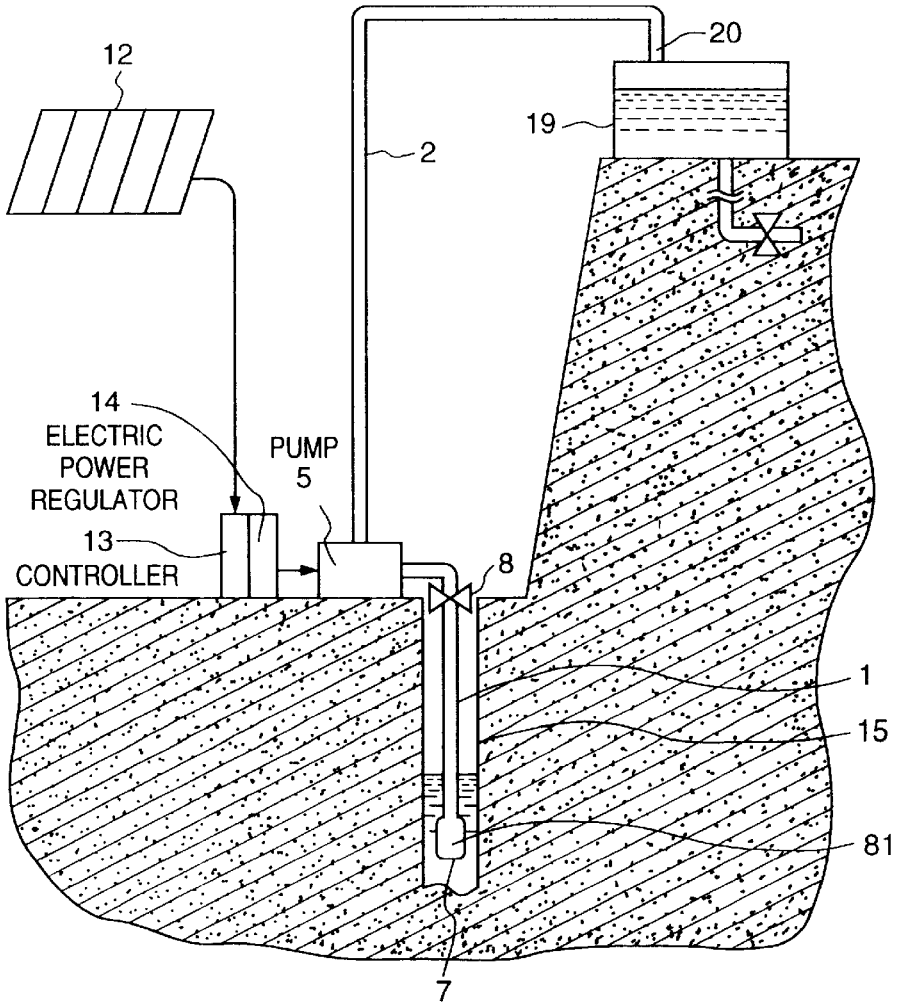
FIG. 12 (PRIOR ART)
FIG. 12 is a diagram showing a configuration of a water supply apparatus employing a solar pump system.

In the water supply system shown in FIG. 1, when the insolation is strong, the first and second valves 8 and 9 are opened, and the third and fourth valves 10 and 11 are closed, thereby the same liquid conveyance route as shown in FIG. 12 is formed. Accordingly, it is possible to directly supply water from the well 15 to the discharge opening 20 via the first and second water supply pipes 1 and 2.

Figure 3:
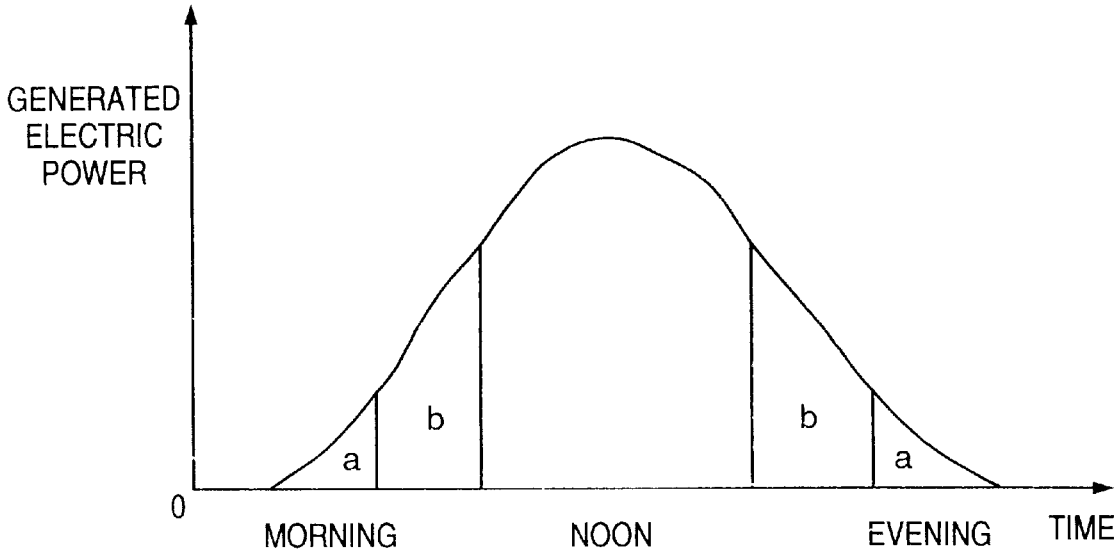
FIG. 3 is a graph showing a transition of the generated electric power in a sunny day.

In this water supply system, the water tank 6 is provided in the middle of the water supply pipes 1 and 2 which run between the intake 7 and the discharge opening 20. Therefore, by setting the height of the drawing route of the water from the water surface of the well 15 to the water tank 6 and the height from the water tank 6 to the discharge opening 20 to about a half of the height from the water level of the well 15 to the discharge opening 20, the required power of the pump 5 is halved when the water is drawn up from the wall to the water tank 6 or from the water tank 6 to the discharge opening 20, namely, the electric power which needs to be generated by the solar panel 12 is substantially halved comparing to when drawing water from the well 15 up to the discharge opening 20 directly. Therefore, when the insolation is low as in the mornings and evenings which are referred by a character b in the graph in FIG. 3 showing transition of electric power generated by the solar cell in a day and as on cloudy days, by opening the first and third valves 8 and 10 and closing the second and fourth valves 9 and 11, it is possible to draw the water in the well 15 up to the water tank 6. Further, by closing the first and third valves 8 and 10 and opening the second and fourth valves 9 and 11, it is possible to draw the water in the water tank 6 up to the discharge opening 20.

According to the water supply system shown in FIG. 1, it is possible to draw water from the well 15 to the water tank 6 or from the water tank 6 to the discharge opening 20 even during a low insolation period referred by the character b in FIG. 3. As a result, it is possible to increase the efficiency of the water supply system without wasting the electric power generated during the low insolation period.

Note that the first and second valves 8 and 9 are for preventing backflow of the water in the first and second water supply pipes 1 and 2, and a foot valve and an anti backflow valve which do not require external control may be used. Further, in a case where the discharge opening 20 is separated from the water surface of a not-shown water tank, for example, and the water in the second water supply pipe 2 does not backflow even when the pressure inside of the water supply pipe 2 become negative, the second valve 9 can be omitted.

As the first to fourth water supply pipes 1 to 4, a steel pipe, a copper pipe, a hard vinyl chloride pipe, or a vinyl hose may be used, for instance. Further, for the bending parts of the water supply pipes, an elbow and a flexible pipe may be used, for example. Further, for each branching part, a T-pipe can be used, and nipples, for instance, are used for connection. The bending parts and the branching parts are to be connected to have strength to an extent that water does not leak and the connection endures the water pressure. Further, since a pipe having a larger diameter experiences lesser water pressure, a water supply pipe corresponding to the output of a pump should be used.

As the pump 5, there are a pump using a direct-current motor (called "DC pump", hereinafter) and a pump using an alternating-current motor (called "AC pumps", hereinafter). The DC pump is used by directly connecting to the power source or by connecting to the power source via a DC/DC converter. However, the DC pump has a contact part, such as an armature for rectification. In consideration of the life of the armature, the AC pump, having no contact part, is often used. Especially, in a large system, the AC pump is preferably used. In this case, direct current electric power is converted into alternating current electric power by an inverter, then supplied to the AC pump. Further, there are a centrifugal pump and axial flow pump, for example, as a pump. The type of the pump may be selected in accordance with a utilization purpose, however, the centrifugal pump is preferred when easiness in plumbing is taken into consideration.

As for the water tank 6, there are a tank which is made by digging a hole on the ground, a tank whose walls are solidified by concrete, and a transferable tank made of high density polyethylene and fiberglass reinforced plastic, for example. Any tank can be used as far as the tank can hold water.

A valve, such as a foot valve and an anti-backflow valve, which prevents backflow and an electromagnetic valve are preferred as the first valve 8. Further, the electromagnetic valve, for example, is used as the second to fourth valves 9 to 11.

As for a solar cell used in the solar panel 12, there are solar batteries using non-crystalline silicon such as amorphous silicon, singlecrystalline silicon, polycrystalline silicon, and compound semiconductor. A solar panel having a plurality of solar batteries arranged in parallel or series to configure an array or string for obtaining desired voltage and current is used.

The controller 13 detects the output voltage and output current from the solar panel 12, and activates or deactivates the electric power regulator 14, further controls the output frequency, for example, of the electric power regulator 14 on the basis of the detected value. In this manner, the controller 13 controls the load on the solar panel 12 to perform constant voltage control for fixing the output voltage from the solar panel 12 or maximum power point tracking (MPPT) control for controlling the output from the solar panel 12 to be at the maximum output point, Pmax, at all the time. The controller 13 can be realized by a so-called microcomputer board comprising a CPU, a ROM storing control software, a RAM as a work memory, an I/O port, and A/D and D/A converters.

The electric power regulator 14 may be a DC/AC inverter using power devices, such as power transistors, power MOSFETs, insulated gate bipolar transistors (IGBT), and gate turn-off thyristors (GTO), or a voltage-type self-oscillated DC/AC inverter. By changing the on/off duty ratio and the frequency of a gate pulse to be provided to the power devices, an output voltage and an output frequency, for example, of the electric power regulator 14 can be controlled.

Figure 10:
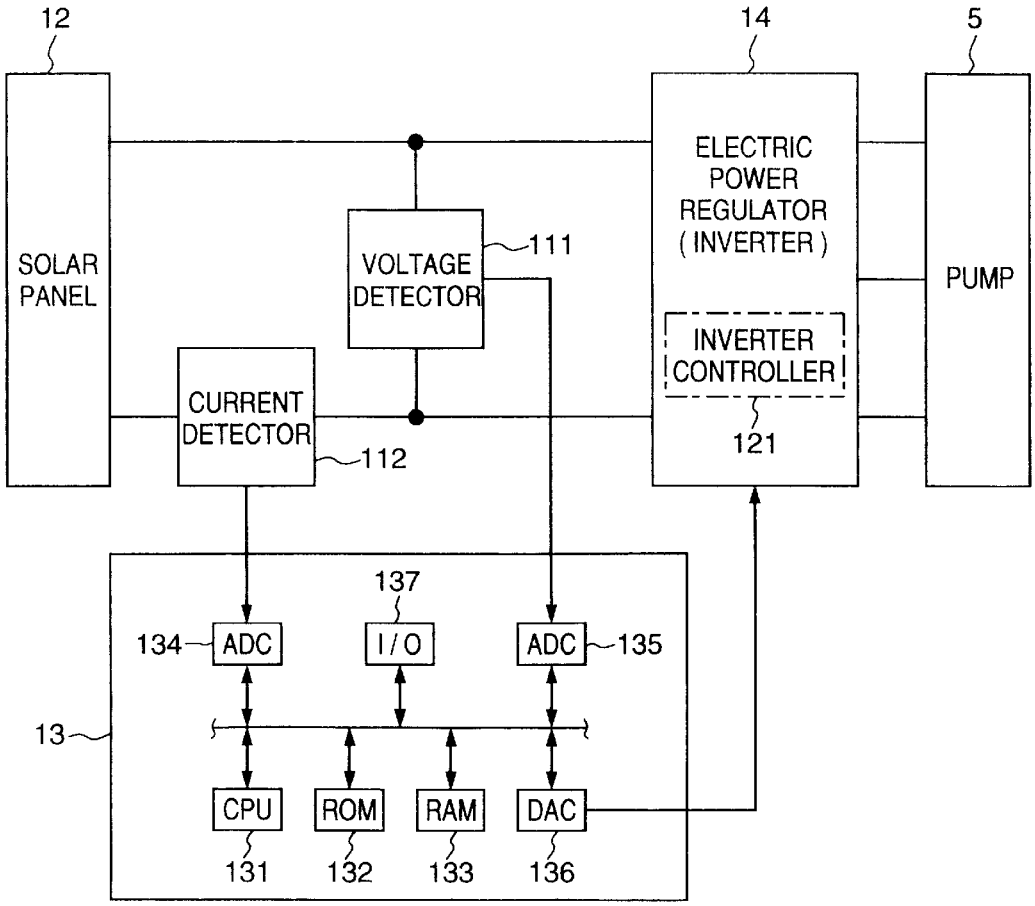
FIG. 10 is a block diagram illustrating a configuration of a control apparatus and an electric power regulator used in a liquid supply system of the present invention.

FIG. 10 is a block diagram illustrating a configuration of the controller 13 and the electric power regulator 14. The controller 13 comprises the aforesaid microcomputer board including a CPU 131, a program ROM 132, and a work RAM 133. The controller 13 reads a voltage value detected by a voltage detector 111, such as a voltage divider using resistors and a current value detected by an current detector 112, such as a shunt resistor, via A/D converters (ADC) 134 and 135. Thereafter, the controller 13 calculates a command reference of the output voltage, current, or frequency of the electric power regulator 14, and transmits the command reference to an inverter controller 121 of the electric power regulator 14 via a D/A converter (DAC) 136. The inverter controller 121 controls switching of the power devices so that the output voltage, current or frequency of the electric power regulator 14 approaches the command reference.

The controller 13 further controls open/close of the first to fourth valves 8 to 11 on the basis of the electric power generated by the solar panel 12 calculated from the voltage and current, respectively detected by the voltage detector 111 and the current detector 112, and a water level of the water tank 6 detected by the water level sensor 21. It should be noted that a detection signal from the water level sensor 21 and an open/close control signals to the first to fourth valves are transmitted and received via an I/O port 137.

Figure 4:
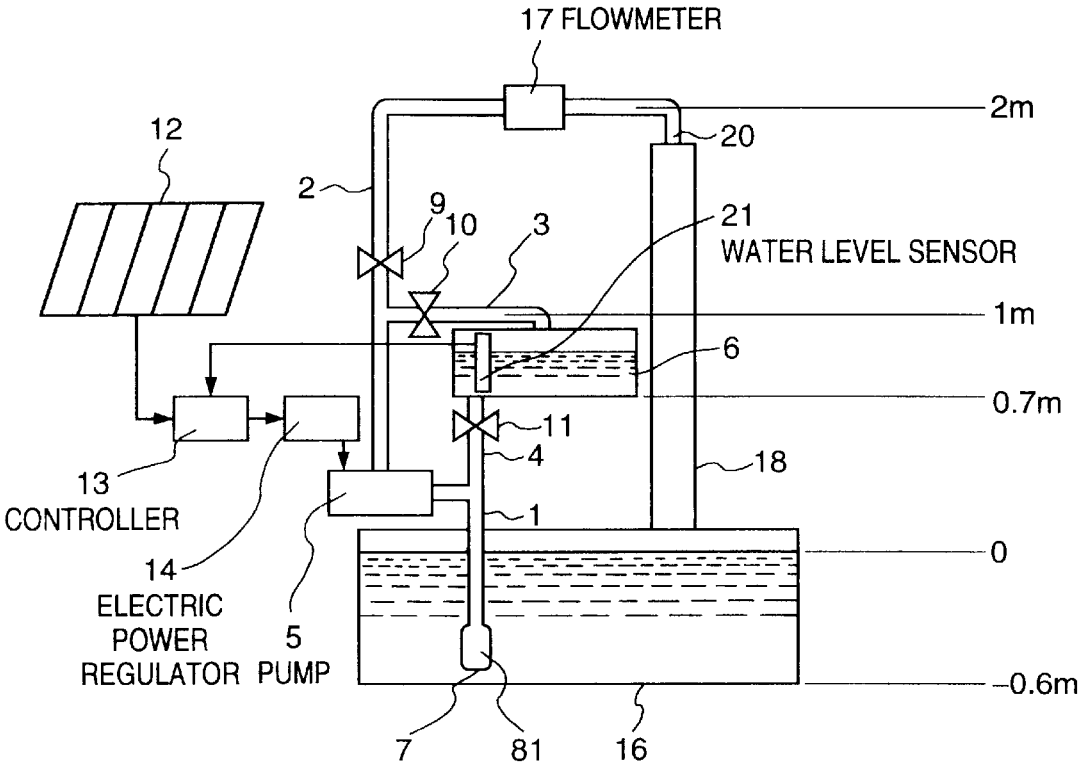
FIG. 4 shows a configuration for measuring performance of the water supply system shown in FIG. 1.

FIG. 4 shows a configuration for measuring performance of the water supply system shown in FIG. 1. In this embodiment, twenty amorphous silicon solar cell modules (available from United Solar System Corporation, Product Type: MBC-131), connected in serial, are used as the solar panel 12. The electric power generated by the solar panel 12 is supplied to an AC three-phase motor direct coupling type magnet pump 5 (available from Sanso Electric Co., Ltd., Product Type: PMD-613B2M) via a general-purpose inverter (available from Mitsubishi Electric Corporation, Product Type: FREQROL-U100) which is the electric power regulator 14.

As for each water supply pipe, a vinyl hose having an internal diameter of 25 mm is used. As shown in FIG. 4, a container 16 of 0.6 m depth for drawing water is prepared from the reference surface (0 m) instead of the well 15, and water is drawn from the container 16 by using the pump 5 via the first water supply pipe 1 provided with a foot valve 81 as the first valve 8 at the end of the water supply pipe 1. Then, the water is drawn from a discharge opening of the pump 5 up to 2 m above the water level via the second water supply pipe 2. The drawn water is returned to the container 16 via a hard vinyl chloride pipe as a drain 18 instead of supplying the water from the discharge opening 20. Further, a flowmeter 17 is provided near the top of the second water supply pipe 2 for measuring the quantity of the water current, and the transition in water current in a day is observed.

The third water supply pipe 3 is provided at 1 m above the reference surface and connected to the middle of the second water supply pipe 2, and the water tank 6 (made of fiberglass reinforced plastic) is set at 0.7 m above the reference surface. The bottom of the water tank 6 is connected to the first water supply pipe 1 via the fourth water supply pipe 4. The electromagnetic valves 9, 10, and 11 are respectively provided in the middle of the second water supply pipe 2 at the position above the connection of the second and third water supply pipes 2 and 3, in the middle of the third water supply pipe 3 at the position which is nearer to the water tank 6 than the connection of the second and third water supply pipes 2 and 3, and in the middle of the fourth water supply pipe 4. The water level sensor 21 is provided in the water tank 6, and the output signal from the water level sensor 21 is inputted to the controller 13.

The output frequency from the electric power regulator 14 is adjusted so that the output from the solar panel 12 reaches the maximum output point, Pmax. This adjustment is realized by measuring the optimal operating voltage Vop at the maximum output point Pmax of the solar panel 12 in advance, and performing constant voltage control for controlling the output frequency from the electric power regulator 14 or performing the aforesaid maximum power point tracking control so that the output voltage from the solar panel 12 reaches Vop when the pump 5 is run by the electric power regulator 14.

In this system, a voltage obtained by dividing the output voltage from the solar panel 12 into 100:1 by the voltage detector 111 is transmitted to an A/D conversion input port of an expansion card (available from Kabushikikaisha Adtek System Science, Product Type: AB98-57B) having a parallel I/O port, and of A/D and D/A converters of 5 V-full scale 12-bit resolution, which is inserted into an extension slot of a personal computer (available from NEC Corporation, Product Type: PC-9801DA). Then, by using this personal computer, the constant voltage control is performed so that the optimal operating voltage Vop, namely, 260 V, can be obtained from the solar panel 12 having the aforesaid configuration. More specifically, deviation of the output voltage from the solar panel 12 and the command voltage (260 V) is calculated by the personal computer on the basis of the voltage inputted to the A/D conversion input port, and the output frequency of the electric power regulator 14 is calculated or obtained from a look-up table so that the deviation approaches 0. Then, data representing the obtained output frequency is transmitted from a D/A conversion output port to the inverter controller 121 of the electric power regulator 14. Further, a start/stop signal and a reset signal are transmitted to the inverter controller 121 via a parallel output port of the extension card in order to start or stop the pump 5 as well as to reset the inverter controller 121.

The control of the electromagnetic valves 9 to 11 is performed by using the personal computer. The electric power generated by the solar panel 12 is calculated from its output voltage and current, and these three electromagnetic valves are controlled to open or close in accordance with the calculated electric power and the water level of the water tank 6. This open/close control is performed in the manner shown in FIG. 13.

In this system, 20 to 40 W of the generated electric power is defined "Low", and more than 40 W of the generated electric power is defined "High". If the generated electric power is "Low", when the water level of the water tank 6 measured by the water level sensor 21 becomes lower than a predetermined water level for start storing water, a water storing mode is set. Whereas, when the water level becomes higher than a predetermined water level for start discharging water, the mode is switched to a water discharge mode. In this system, the water level for start storing water is set to 0.8 cm, and the water level for start discharging water is set to 30 cm. When the amount of insolation is large and the generated electric power is "High", then a direct mode is set regardless of the water level of the water tank 6, and the water is directly drawn up from the container 16. Note, the foot valve 81 as the first valve is automatically opened or closed in accordance with the set mode so that the water does not backflow.

Figure 5:
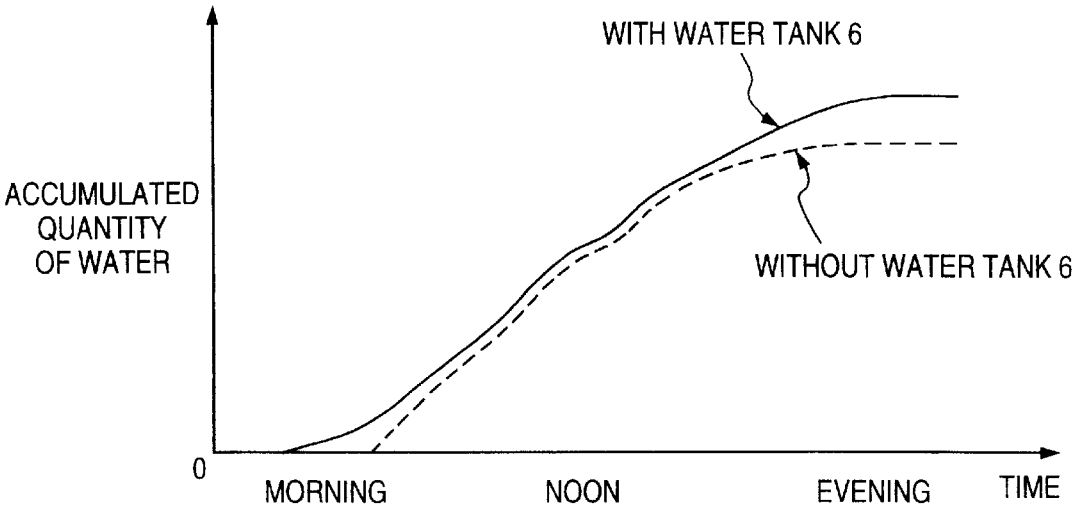
FIG. 5 is a graph showing the amount of drawn water in a day by the water supply system shown in FIG. 4.

As a measured result of the drawn water by the aforesaid water supply system in a day, the graph shown in FIG. 5 is obtained. The total quantity of drawn water in a sunny day with 5.7 kWh of insolation was 13.2 $m^3$. Further, the total quantity of drawn water of a day without using the water tank 6 was 12.1 $m^3$ under the same condition of the insolation. As shown in FIG. 5, it is possible to provide water by effectively using the electric power generated when the insolation is low as in the mornings and evenings.

Note, a water supply system using a plurality of water tanks 6, and a plurality of pumps, water supply pipes, and valves corresponding to respective water tanks 6 which are arranged in a cascade can be considered. With such a configuration, water is temporarily stored in the water tank 6, then the stored water is drawn to the upper water tank 6 when the insolation is low. Such an embodiment is included in the present invention.

In other words, various changes and modifications within the spirit and scope of the present invention, in which drawn liquid is stored in a liquid container and the stored liquid is further drawn up to a position which is above the liquid container when the insolation or wind is weak can be realized as the present invention.

<Second Embodiment>

Figure 6:
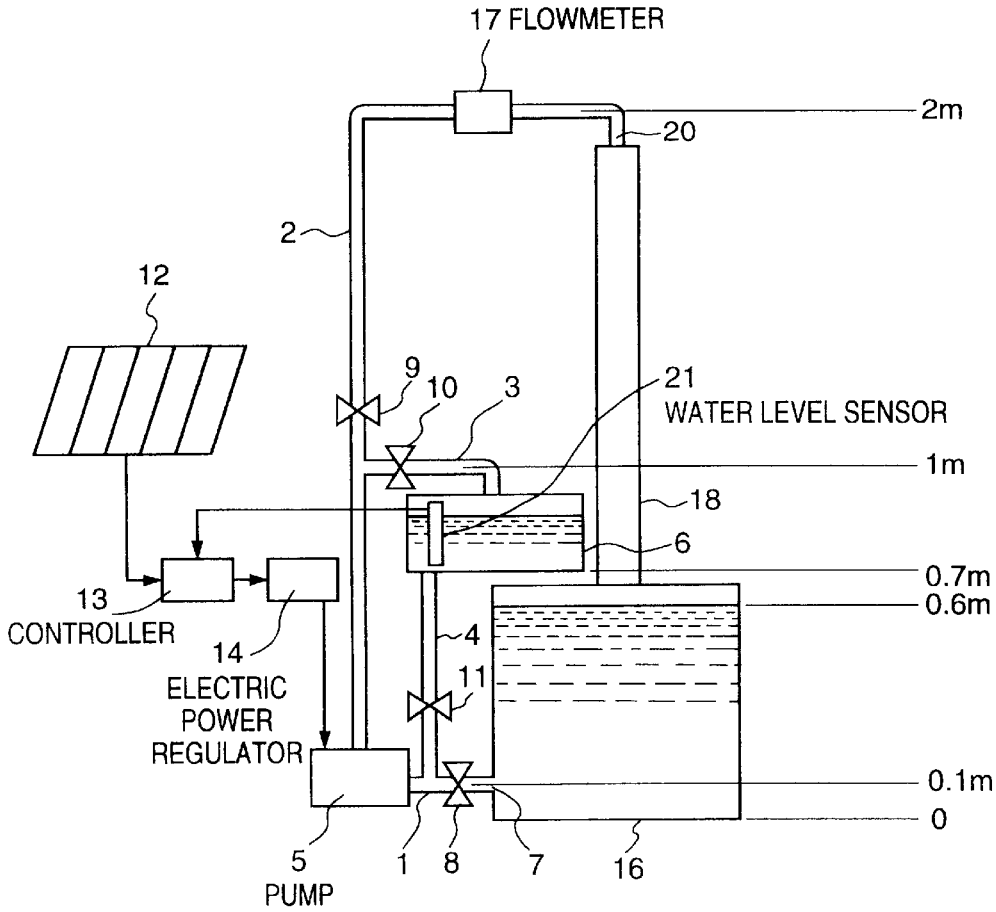
FIG. 6 is a diagram illustrating a configuration of a water supply system according to a second embodiment of the present invention.

FIG. 6 is a diagram illustrating a configuration of a water supply system according to a second embodiment of the present invention. In this embodiment, similarly to the configuration shown in FIG. 4, twenty amorphous silicon solar cell modules (available from United Solar System Corporation, Product Type: MBC-131), connected in serial, are used as the solar panel 12. The electric power generated by the solar panel 12 is provided to an AC three-phase motor direct coupling type magnet pump 5 (available from Sanso Electric Co., Ltd., Product Type: PMD-613B2M) via a general-purpose inverter 14 (available from Mitsubishi Electric Corporation, Product Type: FREQROL-U100).

Further, as for a water supply pipe, a hard vinyl chloride pipe having an internal diameter of 25 mm is used. As shown in FIG. 6, a container 16 of 0.6 m depth for drawing water is prepared from the reference surface (0 m) instead of a well, and connected to the pump 5 at 0.1 m above the bottom of the container 16 via the first water supply pipe 1 and the first valve 8 (electromagnetic valve). The pump 5 draws water up to the discharge opening 20 which is at 2 m above the bottom of the container via the second water supply pipe 2. Further, the flowmeter 17 for measuring the quantity of the water current is provided near the top of the second water supply pipe 2, as in the configuration shown in FIG. 4, and the transition of water current in a day is measured. The drawn water is returned to the container 16 by using the hard vinyl chloride pipe as the drain 18.

The third water supply pipe 3 is provided at 1 m above the reference surface and connected to the middle of the second water supply pipe 2, and the water tank 6 (made of fiberglass reinforced plastic) is set at 0.7 m above the reference surface. The bottom of the water tank 6 is connected to the first water supply pipe 1 via the fourth water supply pipe 4. The electromagnetic valves 9, 10, and 11 are respectively provided in the middle of the second water supply pipe 2 at the position above the connection of the second and third water supply pipes 2 and 3, in the middle of the third water supply pipe 3 at the position which is nearer to the water tank 6 than the connection of the second and third water supply pipes 2 and 3, and in the middle of the fourth water supply pipe 4. The water level sensor 21 is provided in the water tank 6, and the output signal from the water level sensor 21 is inputted to the controller 13.

The controller 13 of the second embodiment has the same configuration as that in the first embodiment, thus, its detailed explanation is omitted. In the second embodiment, the maximum power point tracking control of the solar panel 12 is performed by using an electric power control method as disclosed in the Japanese Patent Application Laid-Open No. 6-348352. In the method disclosed in the above reference, an approximation curve is obtained on the basis of the sampled voltages and currents, then the maximum output point Pmax is found from the approximation curve. This method has an advantage that the maximum output point Pmax can be searched quickly.

The open/close control of the electromagnetic valves 8 to 11 is performed as shown in FIG. 14. In the second embodiment, 20 to 40 W of the generated electric power is defined "Low", and more than 40 W of the generated electric power is defined "High". If the generated electric power is "Low", when the water level of the water tank 6 measured by the water level sensor 21 becomes lower than a predetermined water level for start storing water, a water storing mode is set. Whereas, when the water level becomes higher than a predetermined water level for start discharging water, the mode is switched to a water discharge mode. In this system, the water level for start storing water is set to 0.8 cm, and the water level for start discharging water is set to 30 cm. When the amount of insolation is large and the generated electric power is "High", then a direct mode is set regardless of the water level of the water tank 6, and the water is directly drawn up from the container 16.

Figure 7:
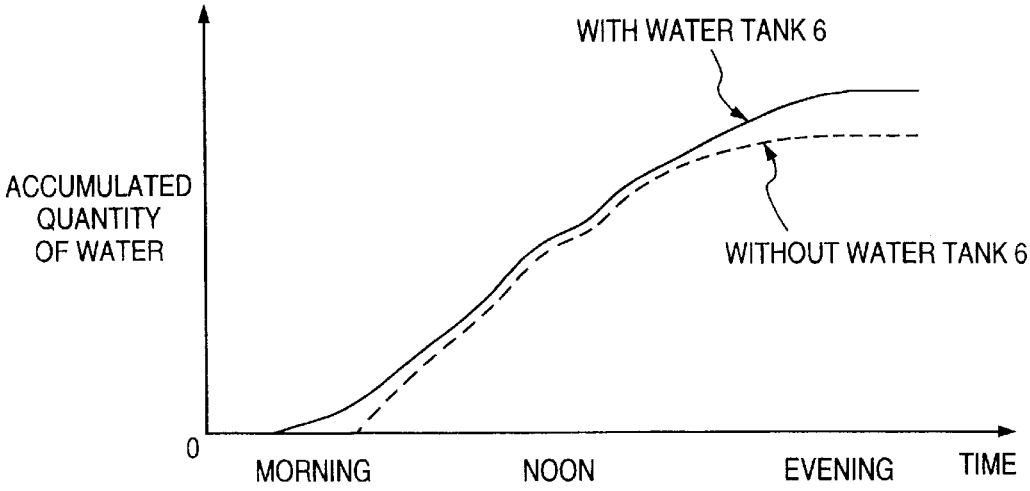
FIG. 7 is a graph showing the amount of drawn water in a day by the water supply system shown in FIG. 6.

The measurement result of the amount of drawn water by using the aforesaid water supply system in a day is as the graph shown in FIG. 7. The total amount of drawn water in a day was 13.6 $m^3$ in the same condition of the insolation as in the first embodiment. Further, in the same condition, the total of water drawn without using the water tank 6 in a day was 12.4 $m^3$. In the water supply system in the second embodiment as shown in FIG. 7, it is possible to provide water by effectively using the electric power generated when the insolation is low as in the mornings and evenings.

<Third Embodiment>

Figure 8:
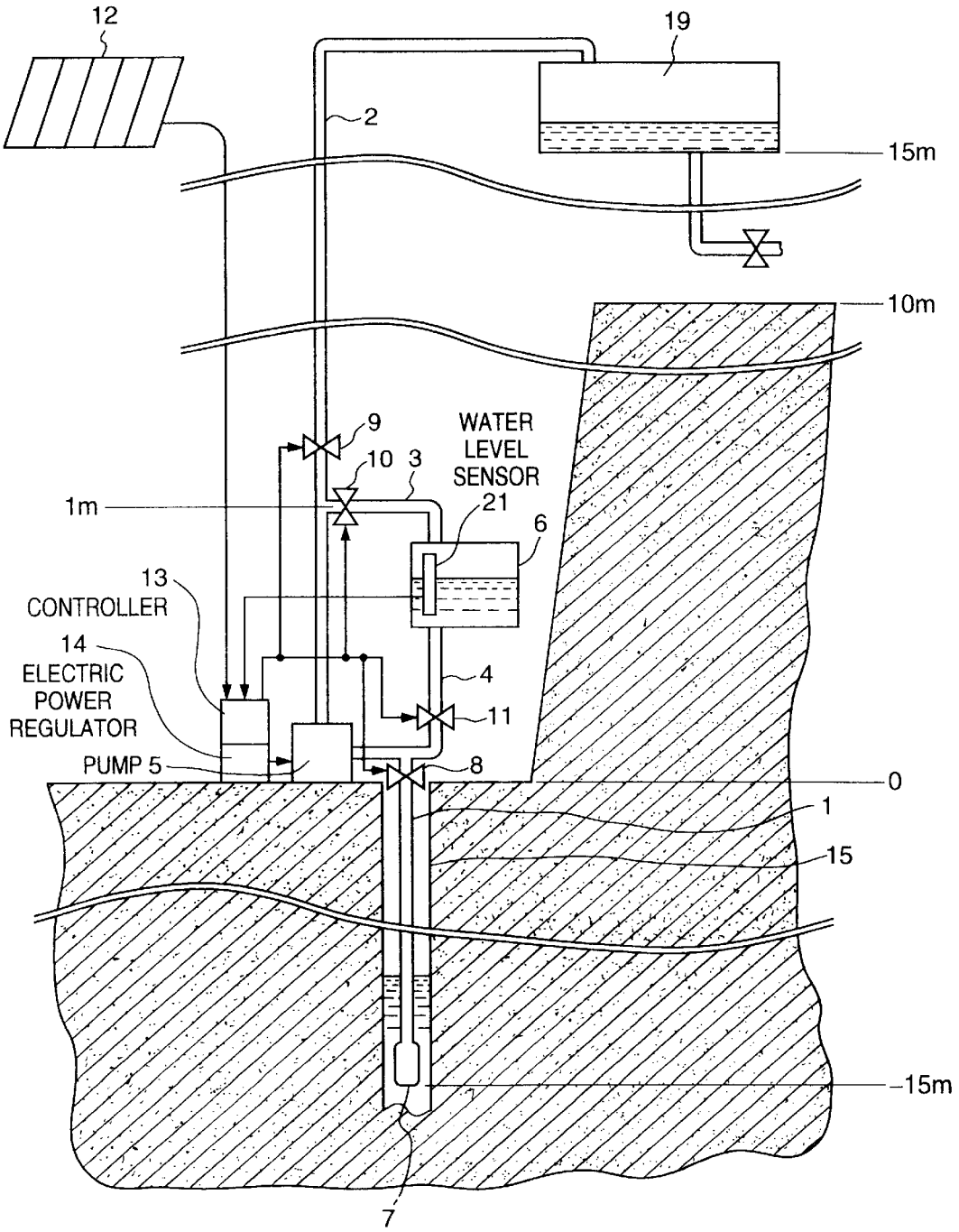
FIG. 8 is a diagram illustrating a configuration of a water supply system according to a third embodiment of the present invention.

FIG. 8 is a diagram illustrating a configuration of a water supply system according to a third embodiment of the present invention. In the third embodiment, an array made with four strings, connected in parallel, each of which is configured with seventeen amorphous silicon solar cell modules (available from United Solar System Corporation, Product Type: UPM-880), connected in serial, is used as the solar panel 12. The electric power generated by the solar panel 12 is supplied to an AC three-phase motor direct coupling type magnet pump 5 whose power output is 1.5 kW via a general-purpose inverter which is the electric power regulator 14. With the pump 5, water is drawn from the well 15 of 15 m depth up to a water tank 19 for water supply which is provided at 15 m above the ground. The water in the water tank 19 is supplied to a public faucet (at 10 m above the ground) which is 20 m away from the water tank 19. Further, the water tank 6 is provided at between 0 and 1 m above the ground for the low insolation condition. The water supply pipe 3 branching from the water supply pipe 2, which provides water to the water tank 19, at the altitude of 1 m is provided, and water is transmitted to the water tank 6 via the water supply pipe 3. The valves 9 and 10 are respectively provided in the water supply pipes 2 and 3, in the side of the water tank 19 and in the side of the water tank 6 with respect to the branching point. Further, the water supply pipe 4 is extended from the bottom of the water tank 6 for the low insolation condition and connects to the water supply pipe 1 which extends from the well 15 via the valve 11. In the middle of the water supply pipe 1, the valve 8 is provided in the side of the intake 7 with respect to the connection of the water supply pipes 1 and 4. These four valves 8 to 11 are electromagnetic valves which can be controlled to open or close in accordance with signals inputted from outside. Further, the water level sensor 21 is installed in the water tank 6 for the low insolation condition.

The controller 13 is configured with a microcomputer board using a 8086 CPU which is available from Intel Corporation. The output frequency of the electric power regulator 14 is calculated from the voltage and current respectively detected by the voltage detector 111 and the current detector 112 as shown in FIG. 10. A general-purpose parallel I/O port, memory, floating-point processing unit (FPU), serial interface, A/D.D/A converters, and the like, are provided in the microcomputer board.

As for the determination method of the output frequency of the electric power regulator 14, an algorithm for the maximum power point tracking control disclosed in Japanese Patent Application Laid-Open No. 6-348352 as in the second embodiment is employed. The calculated result is D/A converted and transmitted to the control circuit of the electric power regulator 14 as an analog signal for frequency setting. Further, a start/stop signal and a reset signal are transmitted to the control circuit of the electric power regulator 14 via the parallel output port of the microcomputer board in order to activate or deactivate the pump 5 and to reset the control circuit of the electric power regulator 14. The open/close control method of each valve is the same as that of the second embodiment.

Figure 9:
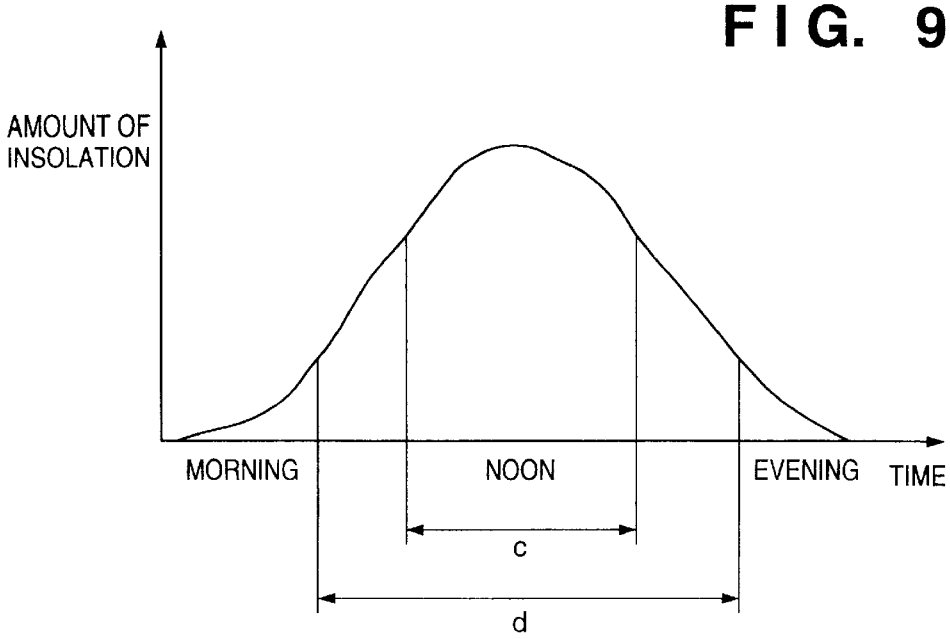
FIG. 9 is a graph for explaining a utilization time period in a day of the water supply system shown in FIG. 8.

As an analyzed result of the driving period of the pump 5 in the above configuration, the necessary electric power to be generated to start operating the pump 5 is 480 W. Therefore, the water supply system of the third embodiment can be operated in a period d in the insolation condition shown in FIG. 9. The operation period is 4 hours and 20 minutes. When the same drawing operation is performed without using the water tank 6, the necessary electric power to start operating the pump 5 is 800 W, and the pump 5 can be operated in the period c in FIG. 9, and the operation period is 3 hours and 40 minutes. Therefore, according to the water supply system according to the third embodiment, it is possible to provide water by effectively using the electric power generated when the insolation is low as in the mornings and evenings.

Figure 11:
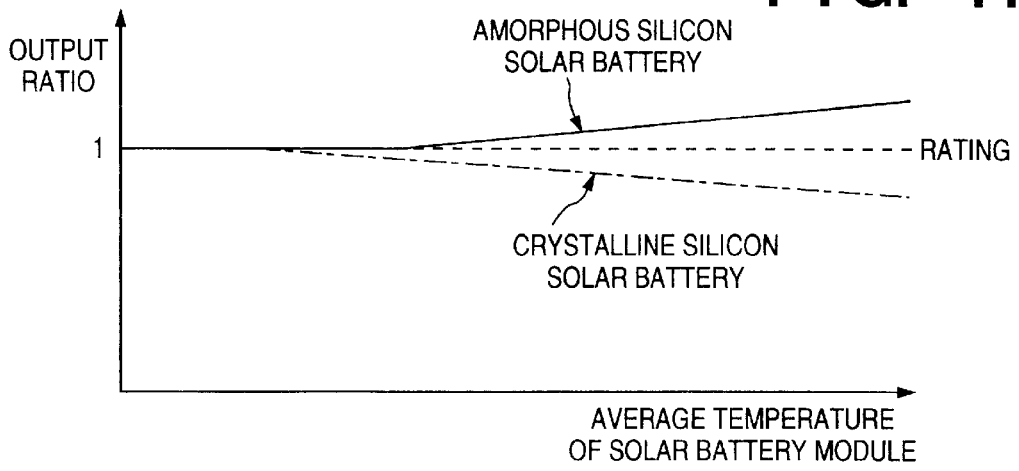
FIG. 11 is a graph showing relationship between the temperature and generated electric power of a solar cell module in an amorphous silicon solar cell and a crystalline silicon solar cell.

Further, as shown in FIG. 11, the amorphous silicon solar cell can achieve an output beyond rating in high temperature. In contrast, the output from the crystalline silicon solar cell is below rating in high temperature. Therefore, in a case of using an irrigation system using the water supply system, as shown in the third embodiment, whose power source is the amorphous silicon solar cell in a high-temperature region, such as a low latitude region, it is possible to decrease the initial setting cost comparing to a case of using the crystalline silicon solar cell.

According to the liquid supply systems according to the above embodiments, by providing a liquid storage container in a middle of the liquid conveyance route to the destination of liquid supply, it is possible to draw the liquid up to the liquid storage container by using a pump even when the insolation is low. Further, with the technique of properly combining a plurality of liquid conveyance routes by opening and closing valves, it is possible to convey the liquid from the liquid storage container to the destination of liquid supply by using the same pump. Of course, the liquid can be conveyed and supplied to the designation of liquid supply directly from the source of liquid supply when the insolation is high.

More specifically, FIG. 3 shows a transition of electric power generated by a solar cell in a sunny day, and in a case of drawing water to the water tank 19 by using the single pump 5, as the water supply system shown in FIG. 12, the electric power generated during the periods a and b shown in FIG. 3 is wasted. However, in the water supply systems according to the above embodiments, only the electric power generated in the periods a is wasted. In other words, according to the water supply systems in the aforesaid embodiments, it is possible to draw water from a well to a water tank, and from the water tank to the destination with the electric power generated during the periods b.

Furthermore, with one pump, liquid can be more effectively conveyed comparing to a case where two pumps of small output ability are used. In addition, the initial cost of the apparatus can be reduced since the required number of pumps is smaller. Further, it is possible to simplify the configuration of the control apparatus.

Further, by using an amorphous silicon solar cell as the solar cell whose output drop is smaller than that of the crystalline silicon solar cell when the temperature is high, the present invention becomes especially advantageous as a water supply system for an irrigation equipment in a high-temperature region, such as a low latitude region.

Operational Sequence

Figure 15:
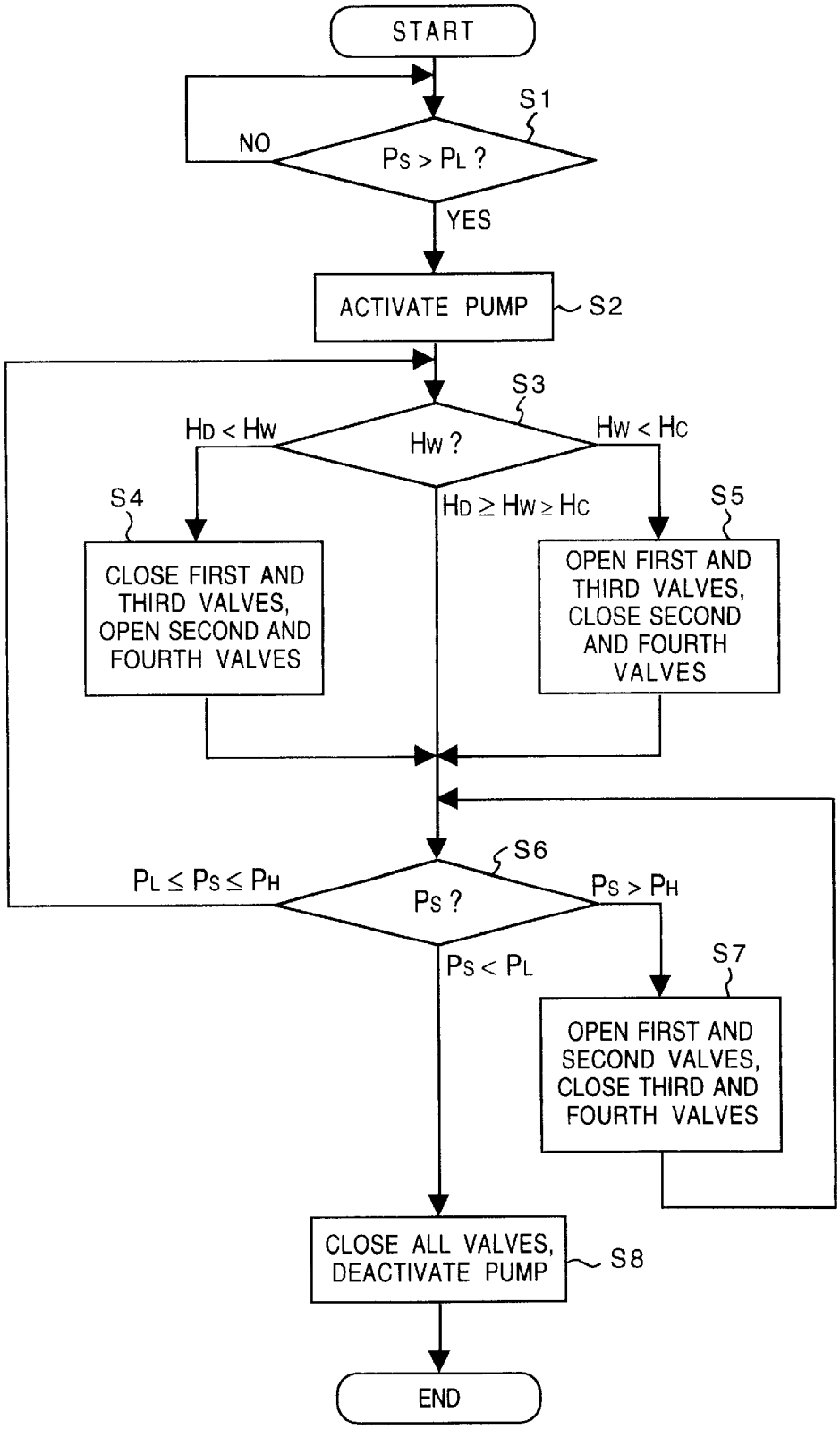
FIG. 15 is a flowchart showing open/close control of a valve and start/stop control of a pump.

FIG. 15 is a flowchart showing an open/close control of valves and a start/stop control of a pump. These controls are realized by the CPU of the controller 13 by executing a program stored in the ROM of the controller 13, and they are commonly employed in the above embodiments.

When the generation of the electric power by the solar panel 12 starts, or when a power switch is turned on, the generated electric power $P_S$ by the solar panel 12 is compared to the electric power $P_L$ required to start operating the pump 5 at step S1. The electric power $P_L$ represents electric power necessary for drawing water through the intake 7 to the water tank 6 and from the water tank 6 to the discharge opening 20 by the pump 5, and $P_L$=20 W in the first embodiment.

Then, if $P_S>P_L$, the pump 5 is activated at step S2. At step S3, the water level $H_W$ of the water tank 6 is measured by the water level sensor 21, and if the $H_W$ exceeds the water level $H_D$ for start discharging water ($H_W>H_D$), the first and third valves 8 and 10 are controlled to close and the second and fourth valves 9 and 11 are controlled to open so as to set to the water discharge mode at step S4. Further, if the $H_W$ is less than the water level $H_C$ for start storing water ($H_W<H_C$), then the first and third valves 8 and 10 are controlled to open and the second and fourth valves 9 and 11 are controlled to close so as to set to the water storing mode at step S5. Note, in the first embodiment, $H_D$=30 cm and $H_C$=0.8 cm. Further, if $H_C \leqq H_W \leqq H_D$, the water discharge mode or the water storing mode is preserved, then the process moves to step S6.

Next at step S6, the generated electric power $P_S$ by the solar panel 12 is obtained, and if it exceeds the electric power $P_H$ which is required for setting to the direct mode, i.e., if $P_S>P_H$, the first and second valves 8 and 9 are controlled to open and the third and fourth valves 10 and 11 are controlled to close so as to set to the direct mode at step S7. The electric power $P_H$ represents necessary electric power for directly drawing water through the intake 7 to the discharge opening 20 by using the pump 5, and $P_H$=40 W in the first embodiment. Further, if the generated electric power $P_S$ is less than $P_L$ ($P_S<P_L$), then all the valves are closed, and the pump 5 is stopped. Further, in a case of $P_L \leqq P_S \leqq P_H$, then the process returns to step S3, and the water discharge mode or the water storage mode is preserved or started.

Therefore, if the generated electric power $P_S$ by the solar panel 12 exceeds $P_L$ (e.g., 20 W), the water supply starts. If the generated electric power is in the range between $P_L$ and $P_H$ (e.g., between 20 W and 40 W), the water discharge mode and the water storing mode are alternatively set. Further, if the generated electric power $P_S$ exceeds $P_H$, then the water is supplied in the direct mode. Then, if the generated electric power $P_S$ becomes less than $P_L$, then all the valves are closed, and the pump 5 is deactivated.

Note, by making the controller 13 operate always by a battery and returning the process to step S1 after step S8 is completed, it is possible to easily realize a system which automatically starts supplying water when the generated electric power $P_S$ by the solar panel 12 recovers with a simple configuration. Further, it is also advantageous to configure the system so that, when the generated electric power $P_S$ by the solar panel 12 recovers to a predetermined level, the electric power is automatically supplied to the controller 13, for realizing a system which automatically starts supplying water.

Conclusion

In the liquid supply systems whose power source is a solar cell according to the above embodiments, the following advantages can be achieved.

(1) When the insolation is too low to draw liquid up to a destination of supply, the liquid is temporarily stored in a liquid container provided at a position below the destination, then the liquid stored in the liquid container is sent to the destination by controlling a conveyance routes by using valves. Accordingly, it is possible to increase utilization efficiency of the electric power generated by the solar cell.

(2) By using a pump of large output ability, the pumping efficiency is improved and the initial setting cost of the system, utilizing the electric power generated in low insolation period, is reduced comparing to a system using a plurality of pumps of small output ability.

(3) The control apparatus, and the like, can be realized by a simple configuration comparing to a case of using a plurality of pumps.

(4) By using an amorphous silicon solar cell as the solar cell whose output drop is smaller than the crystalline silicon solar cell in high temperature, the present invention becomes especially advantageous as a water supply system for an irrigation equipment in a high-temperature region, such as a low latitude region.

(5) Maintenance of the system of the present invention is easier than a system which charges electric power generated by a solar cell to a storage battery, thus the maintenance cost is inexpensive.

The present invention is not limited to the above embodiments and various changes and modifications can be made within the spirit and scope of the present invention. Therefore to appraise the public of the scope of the present invention, the following claims are made.

What is claimed is:

1. A conveying apparatus which employs an unstable electric power supply as its power source for conveying liquid, said apparatus comprising:

a first route for conveying the liquid from an intake to a pump;

a second route for conveying the liquid from said pump to a discharge portion which is provided above said pump;

a third route for conveying the liquid from said pump to liquid storage means provided at a position which is below said discharge portion and above said pump;

a fourth route for conveying the liquid from said liquid storage means to said pump;

operating means for opening and closing said first, second, third and fourth routes; and means for detecting an electric power level, wherein in a case where available electric power level which can be supplied from said unstable electric power supply to said pump is detected to exceed a predetermined electric power level, said first and second routes are opened and said third and fourth routes are closed by said operating means to convey the liquid from said intake to said discharge portion, and in a case where the available electric power level is detected to be lower than the predetermined electric power level, said first and third routes are opened and said second and fourth routes are closed by said operating means to convey the liquid from said intake to said liquid storage means.

2. The apparatus according to claim 1, further comprising a liquid amount detector, wherein when a detected amount of the liquid stored in said liquid storage means exceeds a first predetermined amount, said first and third routes are closed by said operating means.

3. The apparatus according to claim 1, further comprising a liquid amount detector, wherein, in a case where the available electric power level is equal or less than the predetermined electric power level, when a detected amount of the liquid stored in said liquid storage means exceeds a first predetermined amount, said second and fourth routes are opened and said first and third routes are closed by said operating means to convey the liquid from said liquid storage means to said discharge portion.

4. The apparatus according to claim 3, wherein when a detected amount of the liquid stored in said liquid storage means becomes equal or less than a second predetermined amount which is less than the first predetermined amount, said second and fourth routes are closed and said first and third routes are opened by said operating means to convey the liquid from said intake to said liquid storage means.

5. The apparatus according to claim 1, wherein said unstable electric power supply is a solar power generation apparatus or a wind power generation apparatus.

6. The apparatus according to claim 1, wherein said unstable electric power supply includes an amorphous silicon solar cell.

7. The apparatus according to claim 1, wherein each of said first to fourth routes include a valve, and said operating means opens and closes said valves in each of said first to fourth routes.

8. The apparatus according to claim 7, wherein each said valve comprises an electromagnetic valve.

9. A conveying apparatus which employs an unstable electric power supply as its power source for conveying fine powder, said apparatus comprising:

a first route for conveying the fine powder from an intake of the fine powder to a pump;

a second route for conveying the fine powder from said pump to a discharge portion of the fine powder which is provided above said pump;

a third route for conveying the fine powder from said pump to a storage means provided at a position which is below said discharge portion and above said pump;

a fourth route for conveying the fine powder from said storage means to said pump;

operating means for opening and closing said first, second, third and fourth routes; and means for detecting an electric power level, wherein in a case where available electric power level which can be supplied from said unstable electric power supply to said pump is detected to exceed a predetermined electric power level, said first and second routes are opened and said third and fourth routes are closed by said operating means to convey the fine powder from said intake to said discharge portion, and in a case where the available electric power level is detected to be lower than the predetermined electric power level, said first and third routes are opened and said second and fourth routes are closed by said operating means to convey the fine powder from said intake to said storage means.

10. The apparatus according to claim 9, further comprising a fine powder detector, wherein when a detected amount of the fine powder stored in said storage means exceeds a first predetermined amount, said first and third routes are closed by said operating means.

11. The apparatus according to claim 7, further comprising a fine powder detector, wherein, in a case where the available electric power level is equal or less than the predetermined electric power level, when a detected amount of the fine powder stored in said storage means exceeds a first predetermined amount, said second and fourth routes are opened and said first and third routes are closed by said operating means to convey the fine powder from said storage means to said discharge portion.

12. The apparatus according to claim 9, wherein when a detected amount of the fine powder stored in said storage means becomes equal or less than a second predetermined amount which is less than the first predetermined amount, said second and fourth routes are closed and said first and third routes are opened by said operating means to convey the fine powder from said intake to said storage means.

13. The apparatus according to claim 9, wherein said unstable electric power supply is a solar power generation apparatus or a wind power generation apparatus.

14. The apparatus according to claim 9, wherein said unstable electric power supply includes an amorphous silicon solar cell.

15. A conveying apparatus for conveying liquid or fine powder by employing an unstable electric power supply as its power source, said apparatus comprising:

a first pipe connecting an intake and a pump;

a second pipe connecting said pump and a discharge portion which is provided above said pump;

a third pipe connecting said pump and a tank provided at a position which is below said discharge portion and above said pump;

a fourth pipe connecting said tank and said pump;

first to fourth valves which are respectively provided in the middle of said first to fourth pipes; and control means for detecting available electric power level supplied from said unstable electric power supply to said pump and a storage amount in said tank, and controlling at least said third and fourth valves out of said first to fourth valves in accordance with a detection result, wherein, in a case where available electric power level exceeds a predetermined electric power level, said control means controls said first and second valves to open and said third and fourth valves to close to convey the liquid or fine powder from said intake to said discharge portion, and in a case where the available electric power level is equal or less than the predetermined electric power level and the storage amount in said tank exceeds a first predetermined amount, said control means controls said first and third valves to open and said second and fourth valves to close to convey the liquid or fine powder from said tank to said discharge portion, and in a case where the available electric power level is equal or less than the predetermined electric power level and the storage amount in said tank is equal or less than a second predetermined amount which is smaller than the first predetermined amount, said control means controls said first and third valves to open and said second and fourth valves to close to convey the liquid or fine powder from said intake to said tank.

16. A conveying apparatus which employs an unstable electric power supply as its power source for conveying conveyable matter, said apparatus comprising:

a first route for conveying the conveyable matter from an intake to a conveyor;

a second route for conveying the conveyable matter from said conveyor to an outlet;

a third route for conveying the conveyable matter from said conveyor to an intermediate position which is between said intake and said outlet;

a fourth route for conveying the conveyable matter from said intermediate position to said conveyor; and control means for controlling a flow of the conveyable matter based on an output of said unstable electric power supply which is supplied to said conveyor, wherein in a case where the output of said unstable electric power supply exceeds a predetermined output, said control means opens said first and second routes and closes said third and fourth routes to allow conveyance of the conveyable matter from said intake to said outlet, and in a case where the output of said unstable electric power supply does not exceed the predetermined output, said control means opens said first and third routes and closes said second and fourth routes to allow conveyance of the conveyable matter from said intake to said intermediate position.

17. The apparatus according to claim 16, wherein said conveyor comprises a pump.

18. The apparatus according to claim 16, further comprising storage means, for storing the conveyable matter, provided at the intermediate position.

19. The apparatus according to claim 18, wherein said storage means comprises sensing means for sensing a volume of the conveyable matter stored in said storage means.

20. The apparatus according to claim 16, further comprising storage means, for storing the conveyable matter, provided at said intermediate position, wherein said storage means comprises sensing means for sensing a volume of the conveyable matter stored in said storage means, and said sensing means and said control means are electrically connected to supply an output of said sensing means to said control means.

21. The apparatus according to claim 16, wherein the conveyable matter is liquid.

22. The apparatus according to claim 16, wherein said apparatus has said unstable electric power supply.

23. The apparatus according to claim 22, wherein said unstable electric power supply is a solar power generation apparatus.

24. The apparatus according to claim 23, wherein said solar power generation apparatus comprises an amorphous silicon solar battery.

25. The apparatus according to claim 22, wherein said unstable electric power supply is a wind power generation apparatus.

26. The apparatus according to claim 16, wherein the output of said unstable electric power supply and the predetermined output are determined electric power.

27. The apparatus according to claim 16, wherein the outlet is provided above said intake.

28. The apparatus according to claim 16, wherein said first route includes an electromagnetic valve controlled by said control means.

29. The apparatus according to claim 16, wherein said second route includes an electromagnetic valve controlled by said control means.

30. The apparatus according to claim 16, wherein said third route includes an electromagnetic valve controlled by said control means.

31. The apparatus according to claim 16, wherein said fourth route includes an electromagnetic valve controlled by said control means.

32. The apparatus according to claim 16, wherein said first route includes a foot valve controlled by said control means.

* * * * *

UNITED STATES PATENT AND TRADEMARK OFFICE

CERTIFICATE OF CORRECTION

PATENT NO. : 6,050,779
DATED : April 18, 2000
INVENTOR(S) : Yoshitaka Nagao, et al.

It is certified that error appears in the above-identified patent and that said Letters Patent is hereby corrected as shown below:

Column 3,
Line 10, "OF" should read -- OF THE --.
Line 22, "in" should read -- on --.
Line 41, "showing" should read -- showing a --.

Column 5,
Line 8, " "AC pumps"," should read -- "AC pump", --.

Column 10,
Line 10, "A/D.D/A" should read -- A/D•D/A --.
Line 65, "in" (first occurrence) should read -- on --.

Column 14,
Line 16, "claim 7" should read -- claim 9 --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*